US012628884B1

(12) United States Patent
Tadmori

(10) Patent No.: US 12,628,884 B1
(45) Date of Patent: May 19, 2026

(54) BREAST SUPPORT DEVICE FOR SHOWER USE

(71) Applicant: Alaa M. Tadmori, Vienna, VA (US)

(72) Inventor: Alaa M. Tadmori, Vienna, VA (US)

( * ) Notice: Subject to any disclaimer, the term of this patent is extended or adjusted under 35 U.S.C. 154(b) by 0 days.

(21) Appl. No.: 19/414,803

(22) Filed: Dec. 10, 2025

Related U.S. Application Data

(60) Provisional application No. 63/831,328, filed on Jun. 27, 2025.

(51) Int. Cl.
*A41C 3/00* (2006.01)

(52) U.S. Cl.
CPC ..... *A41C 3/0021* (2013.01); *A41C 3/005* (2013.01)

(58) Field of Classification Search
CPC ..... A41C 3/0021; A41C 5/005
See application file for complete search history.

(56) References Cited

U.S. PATENT DOCUMENTS 2,079,426 A * 5/1937 Schottenfels ..... A41C 3/065 2/314
2,406,699 A * 8/1946 Lustig ..... A41C 3/00 450/64
2,475,893 A * 7/1949 Hayes ..... A41C 3/00 D2/709
2,579,365 A * 12/1951 Conde ..... A41C 3/10 D2/706
3,176,686 A * 4/1965 Barnes ..... A63B 71/12 602/73
4,028,740 A * 6/1977 Luerken ..... A41D 7/005 2/67
5,032,103 A * 7/1991 Larsson ..... A61J 13/00 450/38
6,015,331 A 1/2000 Ioakim
6,113,460 A * 9/2000 McKeown ..... A41C 3/08 450/11
6,319,092 B1 * 11/2001 Leyhe ..... A41C 3/0071 450/36

(Continued)

OTHER PUBLICATIONS https://ragoshapewear.com/products/rago-style-1019-the-perky-lift-by-rago?variant=18097314889839&country=US&currency=USD&utm_medium=product_sync&utm_source=google&utm_content=sag_organic&utm_campaign=sag_organic&gad_source=1&gbraid=0AAAAADkv9ZTTgXCEdcjW710HI0a1zRgM_&g clid=Cj0KCQjwzYLABhD4ARIsALySuCQmctCGbRowVifMKjaKD6CS7fHA2vAnKqov-w7B21_Y_dD03JapAClaArkpEALw_wcB.

*Primary Examiner* — Gloria M Hale
(74) *Attorney, Agent, or Firm* — Anthony L. Bacon

(57) ABSTRACT

A breast support device for preventing breast sagging during shower use comprises a support platform configured to provide underneath shelf-like support to breasts, counteracting downward forces of gravity and water weight. The support platform comprises a rigid substrate maintaining structural integrity under continuous water exposure and a plurality of drainage openings preventing water accumulation. A strap system coupled to the support platform secures the device to a user's body during dynamic shower movements. The support platform further comprises a silicone comfort layer disposed on the rigid substrate for skin comfort when wet. The rigid substrate comprises materials selected from stainless steel, medical-grade plastic, coated metal, or composites. The drainage openings are positioned to facilitate shower water flow while maintaining structural support. A front-mounted fastening mechanism enables easy operation with wet or soapy hands. The support platform is contoured to conform to under-breast anatomy, providing lift while allowing complete washing access.

19 Claims, 2 Drawing Sheets

(56) References Cited

U.S. PATENT DOCUMENTS

| | | | | |
|---|---|---|---|---|
| 7,056,187 | B2 * | 6/2006 | Cassity | A41C 3/0021 450/60 |
| D584,879 | S * | 1/2009 | Venus | D2/706 |
| 8,007,343 | B1 * | 8/2011 | Komsky | A41C 3/00 2/268 |
| 8,047,892 | B1 * | 11/2011 | Dempsey | A41C 3/005 450/57 |
| 8,425,274 | B1 * | 4/2013 | Ratcliff | A44C 5/00 450/86 |
| D792,053 | S * | 7/2017 | Chen | D2/706 |
| 9,700,080 | B1 * | 7/2017 | Hansraj | A41C 3/0021 |
| 9,833,365 | B2 | 12/2017 | Lucas et al. | |
| 11,197,506 | B2 * | 12/2021 | Arshava | A41C 3/0064 |
| 11,672,284 | B1 * | 6/2023 | Furis | A41C 3/12 450/86 |
| 11,832,658 | B2 | 12/2023 | Evold | |
| 11,950,641 | B1 * | 4/2024 | Meng | A41F 15/002 |
| 2004/0128733 | A1 * | 7/2004 | Hendricks | A41D 7/00 2/69 |
| 2007/0184753 | A1 * | 8/2007 | Dixon | A41D 3/08 450/58 |
| 2009/0004950 | A1 * | 1/2009 | Sgro | A41C 3/02 450/85 |
| 2016/0000154 | A1 * | 1/2016 | Furis | A41C 3/005 450/80 |
| 2021/0169152 | A1 * | 6/2021 | Choudhury | A41C 3/005 |
| 2021/0401070 | A1 * | 12/2021 | Sorokina | A41C 3/128 |
| 2022/0295908 | A1 * | 9/2022 | Mott | A41C 3/0021 |

* cited by examiner

BREAST SUPPORT DEVICE FOR SHOWER USE

CROSS-REFERENCE TO RELATED APPLICATIONS

This application claims priority to U.S. Provisional Patent Application No. 63/831,328 filed on Jun. 27, 2025, the entire contents of which are hereby incorporated by reference thereto in its entirety.

FIELD OF THE INVENTION

The present disclosure relates generally to personal care devices. More particularly, the present disclosure relates to breast support devices configured for use in showers.

BACKGROUND

The following discussion of related art is provided to assist the reader in understanding the advantages of the present disclosure. This discussion is not an admission that any of the information provided herein is prior art or relevant to the presently claimed subject matter, or that any publication specifically or implicitly referenced is prior art.

Sagging breasts affect most women in their lifetime. There are a wide range of causes. Factors such as the size and weight of the breast and the influence of gravity can cause stretching over time, and aging can break down collagen and elastin fibers in breast tissue, further exacerbating the effects of gravity. Other factors include skin elasticity, hormone changes and health. Various breast support solutions exist to reduce these effects and may include sports bras for exercise, swimsuit tops for swimming and post-surgical supports for medical care. None of these solutions addresses the unique requirements of shower use and hygiene.

During daily showering, breasts experience significant gravitational forces that pull and stretch breast tissue downward, which may cause immediate discomfort and contribute to long-term sagging. This gravitational pull is substantially exacerbated by the weight and downward force of shower water, which adds continuous pressure on breast tissue throughout the duration of the shower. The combination of gravity, water weight, and the dynamic movements involved in washing creates a daily challenge that affects millions of women.

This shower-specific breast sagging causes multiple problems including immediate physical discomfort, back pain from unsupported breast weight, shoulder strain, poor posture, and psychological discomfort from the daily experience of unsupported sagging. Women often report rushing through showers or avoiding certain washing movements to minimize discomfort. Despite showering being a daily necessity, supporting breasts during showering is a problem that remains unsolved.

Shower use requires a support system that can withstand constant water flow, allow full access to all breast areas for washing, resist soap and temperature variations, and provide upward support against gravity while maintaining hygiene. Traditional fabric-based supports retain water and soap, creating hygiene concerns, while adhesive products lose effectiveness when exposed to soap and water.

There remains an unmet need for a breast support device specifically designed to prevent gravitational sagging during shower use-one that provides firm upward support while allowing complete washing access, manages water flow effectively, and maintains hygiene standards. The present disclosure addresses this specific shower-time support need through a novel support platform design.

SUMMARY

The present disclosure provides a breast support device specifically designed to prevent gravitational breast sagging during shower use. The device addresses the unique challenges outlined above. The embodiments described herein are provided as examples and should not be construed as limiting the scope of the disclosure. Features from different embodiments may be combined, modified, or omitted as appropriate for particular applications.

In some embodiments, a breast support device for preventing sagging during showering may comprise a support platform configured to provide underneath support to breasts, functioning as a shelf that lifts breast tissue upward against gravitational forces. The support platform may be constructed from rigid or semi-rigid materials that may maintain structural integrity when exposed to continuous shower water, soap, and temperature variations. The device may further comprise a strap system that may secure the support platform to a user's body during dynamic shower movements.

The support platform may include drainage features that may allow water to flow through the device. In some embodiments, the drainage features may comprise perforations or openings strategically positioned to facilitate water drainage while maintaining structural support.

A comfort layer may be provided on surfaces that may contact the user's skin. The comfort layer may comprise silicone or other biocompatible materials that may provide cushioning and may prevent skin irritation.

The strap system may comprise adjustable shoulder straps that may be configured to accommodate various body sizes and shapes. A fastening mechanism may be provided to facilitate donning and removal of the device.

The embodiments described herein may provide critical upward support to prevent gravitational breast sagging specifically during showering, while allowing complete access for washing all breast areas. The device may counteract the combined downward forces of gravity and water weight, thereby reducing the back pain, shoulder strain, and discomfort that many women experience during daily showers.

These and other aspects, features, and advantages of the present disclosure will become apparent from the following detailed description when taken in conjunction with the accompanying drawings.

BRIEF DESCRIPTION OF THE DRAWINGS

The accompanying drawings are included to provide a further understanding of the present disclosure and are incorporated in and constitute a part of this specification. The drawings illustrate embodiments of the present disclosure and together with the description serve to explain the principles of the disclosure. Other embodiments and many of the intended advantages of the present disclosure will be readily appreciated as they become better understood by reference to the following detailed description.

The drawings are not necessarily to scale and may be illustrated by phantom lines, diagrammatic representations, and fragmentary views. In certain instances, details that are not necessary for an understanding of the embodiments or that may render other details difficult to perceive may have been omitted.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description. As used herein, the word "exemplary" means "serving as an example, instance, or illustration." Any embodiment described herein as "exemplary" is not necessarily to be construed as preferred or advantageous over other embodiments.

The present disclosure may be embodied in many different forms and should not be construed as being limited to the embodiments set forth herein. Rather, these embodiments are provided so that this disclosure will be thorough and complete and will fully convey the concept of the disclosure to those skilled in the art. The terminology used herein is for the purpose of describing particular embodiments only and is not intended to be limiting of the present disclosure.

As used throughout this application, the word "may" is used in a permissive sense (i.e., meaning having the potential to), rather than the mandatory sense (i.e., meaning must). Similarly, the words "include," "including," and "includes" mean including but not limited to. The phrase "at least one of" followed by a list means any one of the list or any combination of items in the list.

The terms "first," "second," etc. may be used herein to describe various elements, but these elements should not be limited by these terms. These terms are used to distinguish one element from another. The use of "first," "second," etc. does not imply a temporal relationship or order unless explicitly stated.

Figure 1:
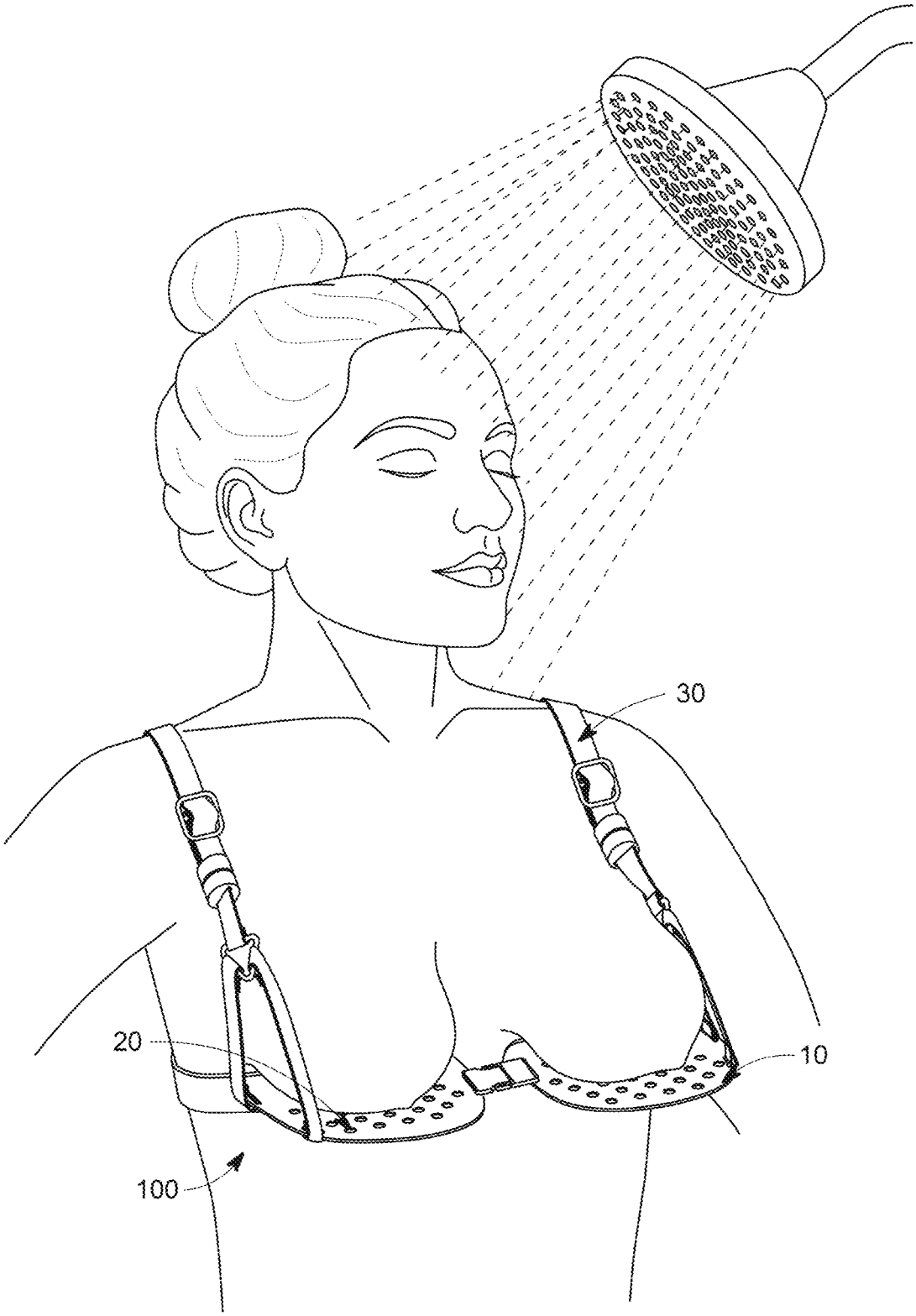
FIG. 1 is a front view of a breast support device according to an embodiment of the present disclosure, shown positioned on a torso.

Referring now to FIG. 1, a breast support device 100 according to an embodiment of the present disclosure may be shown. The device 100 may be configured to provide support to breasts during showering or other wet environment activities.

The device 100 may comprise a support platform 10 that may be positioned beneath the breasts to provide underneath support. The support platform 10 may function as a shelf-like structure that may lift and support breast tissue from below rather than enclosing or gripping the breasts from the front or sides.

The support platform 10 may be constructed from a rigid or semi-rigid substrate material. The substrate material may comprise metals, polymers, composites, or other materials that may maintain structural integrity when exposed to water, soap, and varying temperatures typical of shower environments. In some embodiments, the substrate material may comprise stainless steel, medical-grade plastics, coated metals, or composite materials that may resist corrosion and degradation.

A comfort layer may be provided on the support platform 10. The comfort layer may comprise silicone or other biocompatible materials that may be bonded to or otherwise secured to the substrate material. The comfort layer may provide cushioning and may prevent skin irritation during use. The silicone covering may ensure that the support platform 10 may be gentle against the user's skin.

The support platform 10 may include drainage features 20 that may allow water to flow through the device 100. The drainage features 20 may comprise a plurality of perforations or openings that may be strategically positioned throughout the support platform 10. The perforations may be sized and spaced to facilitate water drainage while maintaining the structural integrity of the support platform 10. The perforations may prevent water accumulation that could cause discomfort or hygiene concerns.

The device 100 may further comprise a strap system 30 that may secure the support platform 10 to the user's body. The strap system 30 may comprise adjustable shoulder straps that may be similar to those found on conventional brassieres. The shoulder straps may be configured to distribute the support load across the user's shoulders and back.

The shoulder straps may comprise water-resistant materials that may resist mildew and degradation in wet environments. The strap materials may be quick-drying synthetic materials that may maintain their properties when repeatedly exposed to moisture.

Figure 2:
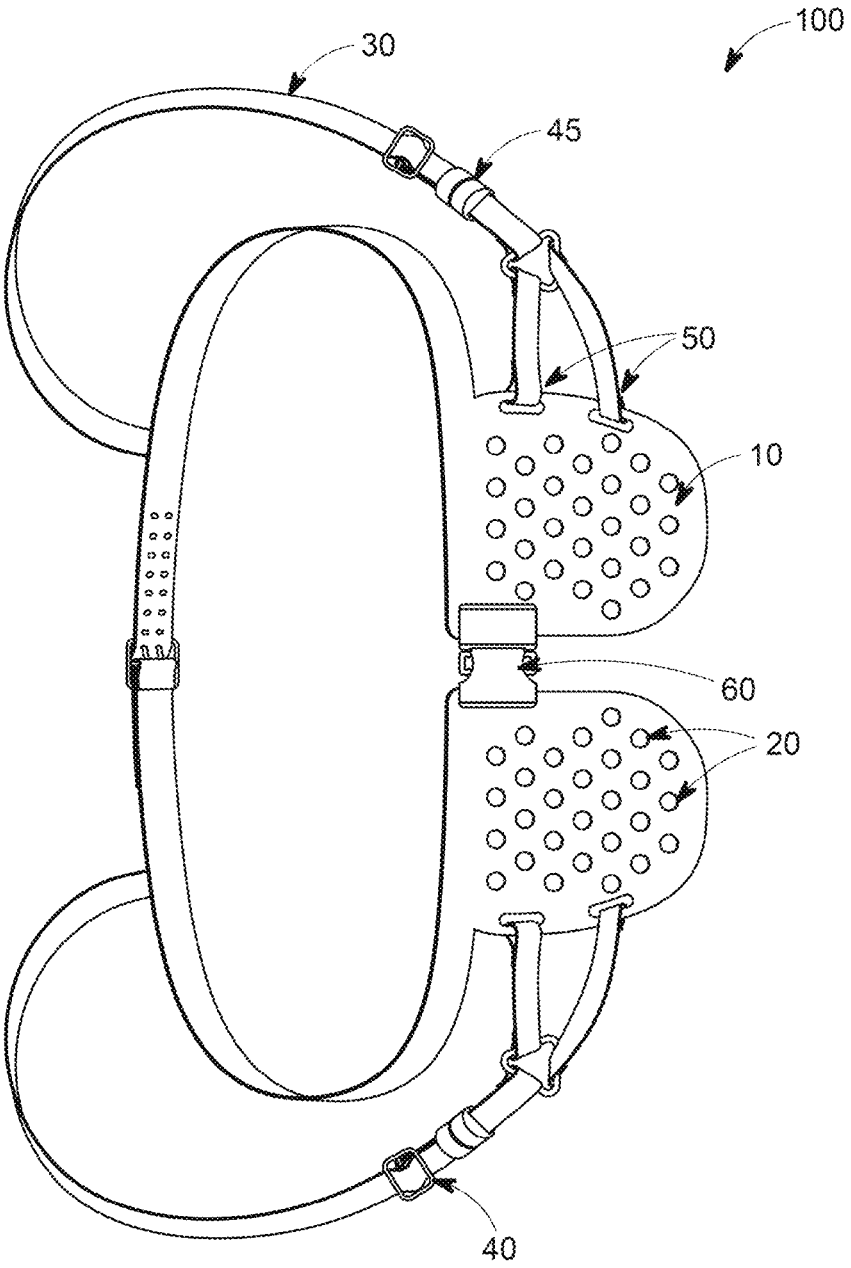
FIG. 2 is a top view of a breast support device according to an embodiment of the present disclosure.

Referring now to FIG. 2, the strap system 30 of device 100 may include adjustment mechanisms 40 that may allow the straps 30 to be sized for different body types and shapes. The adjustment mechanisms 40 may comprise buckles, slides, or other hardware that may enable length adjustment of the straps. The adjustment mechanisms may be constructed from corrosion-resistant materials that may function reliably in wet conditions.

The strap system 30 of device 100 may also include a swivel mechanism 45. Swivel mechanism 45 is located along the straps at any convenient location, but may preferably be located between connection points 50 and the portion of the strap that rests on the shoulders of the user. The swivel mechanisms may allow for rotational motion that lets the upper portion of each strap rotate independently of the lower portion. This configuration enables the straps to conform to the natural shoulder angle while maintaining stable attachment to the support platform 10. This is particularly beneficial where the straps comprise thick or rigid materials that may not naturally bend to follow the natural shape and geometry of the user's shoulders.

In certain embodiments, the strap system 30 may comprise straps configured to provide enhanced support at their attachment to the support platform 10. In one configuration, the straps may be widened at their ends adjacent to connection points 50. In another configuration, the straps may branch or divide near the support platform 10 to create multiple attachment points at connection points 50, forming a Y-shaped or multi-point attachment. Either configuration may provide additional lateral support to the sides of the breasts while maintaining the open front design for ease of access while showering. The widened or branched portions may transition to narrower strap configurations as they extend towards the shoulders and/or swivel mechanism 45. These configurations may distribute support forces more effectively, allowing the straps freedom to conform to the user's body while being optimally positioned for comfort and stability during showering.

Connection points 50 may be provided where the shoulder straps 30 may attach to the support platform 10. The connection points 50 may be reinforced to distribute load forces and may prevent stress concentration that could lead to failure. The connection points 50 may comprise rings, clips, integrated attachment points, or other hardware suitable for transferring forces between the strap system 30 and the support platform 10.

The device 100 may include a fastening mechanism 60 that may facilitate donning and removal of the device. The fastening mechanism 60 may be positioned at the front of the device 100 to enable easy operation with wet or soapy hands. The fastening mechanism 60 may comprise a button, snap, hook, clasp, or other closure system that may provide secure engagement under wet conditions.

The fastening mechanism 60 may be designed to allow quick release for emergency situations while maintaining secure closure during normal use. The fastening mechanism 60 may be constructed from materials that may resist corrosion and may function reliably when exposed to water and cleaning products.

In some embodiments, the support platform 10 may be contoured to conform to the natural anatomy of the under-breast area. The contouring may enhance comfort and may improve the distribution of support forces. The contoured shape may help maintain the position of the device 100 during use and may prevent shifting or displacement.

The support platform 10 may be sized to accommodate different breast sizes and body types. Multiple sizes of the device 100 may be provided to ensure proper fit and support for various users. The sizing may be based on measurements such as band size, cup size, or other anthropometric data.

The device 100 may provide several advantages during showering activities. The underneath support provided by the support platform 10 may help maintain breast position and may reduce sagging caused by gravitational forces. The support may help alleviate back strain by distributing breast weight more effectively across the user's torso.

The drainage features may allow water to flow freely through the device 100, enabling complete access for cleaning and hygiene maintenance. Users may be able to wash all breast areas while maintaining support, which may not be possible with conventional brassieres that may obstruct access to certain areas.

The water-resistant construction of the device 100 may prevent the hygiene concerns associated with wet fabric brassieres. The device 100 may be easily cleaned and may dry quickly after use, reducing the potential for bacterial or fungal growth.

In some embodiments, the device 100 may be used in medical settings where breast lift may be beneficial. For example, the device 100 may be used during surgical procedures, post-surgical recovery, medical examinations, or other healthcare applications where breast support and access may be required.

The adjustable nature of the strap system may allow the device 100 to accommodate users with varying mobility limitations or physical conditions. The front-mounted fastening mechanism may enable users with limited range of motion to don and remove the device 100 independently.

The materials used in the construction of the device 100 may be selected for biocompatibility and may be suitable for extended skin contact. The materials may be hypoallergenic and may not cause adverse reactions in users with sensitive skin.

The device 100 may be designed for repeated use and may maintain its structural and functional properties through multiple cleaning and use cycles. The materials and construction methods may be selected to provide durability and longevity under the demanding conditions of wet environments.

Various modifications and alterations of the present disclosure may become apparent to those skilled in the art without departing from the spirit and scope of the present disclosure. It should be understood that the present disclosure is not intended to be unduly limited to the illustrative embodiments set forth herein. The embodiments described herein are provided as examples only and should not be construed as limiting the scope of the disclosure in any way.

The features described in connection with various embodiments may be combined with features of other embodiments as appropriate. The present disclosure may be embodied in other specific forms without departing from the essential characteristics thereof. The foregoing embodiments are therefore to be considered in all respects illustrative rather than limiting on the present disclosure.

The invention claimed is:

1. A breast support device for preventing breast sagging while showering, the device comprising:

a support platform configured to provide underneath support to breasts without enclosing the breasts, the support platform comprising a rigid substrate;

a strap system coupled to the support platform and configured to secure the support platform to a user's body;

wherein the support platform further comprises a plurality of drainage openings configured to drain shower water away from the support platform.

2. The breast support device of claim 1, wherein the support platform further comprises a comfort layer disposed on the rigid substrate.

3. The breast support device of claim 2, wherein the comfort layer comprises silicone.

4. The breast support device of claim 1, wherein the rigid substrate comprises a material selected from the group consisting of stainless steel, medical-grade plastic, coated metal, and composite material.

5. The breast support device of claim 1, wherein the plurality of drainage openings are strategically positioned to facilitate water flow while maintaining structural integrity of the support platform.

6. The breast support device of claim 1, wherein the strap system comprises adjustable shoulder straps.

7. The breast support device of claim 6, wherein the adjustable shoulder straps comprise water-resistant materials.

8. The breast support device of claim 6, wherein the adjustable shoulder straps comprise integrated swivel mechanisms positioned along a length of the shoulder straps, wherein the swivel mechanism divides the shoulder straps into upper strap portions and lower strap portions, the swivel mechanisms are configured to provide rotational movement of upper strap portions relative to lower strap portions.

9. The breast support device of claim 1, wherein the support platform comprises an integrally formed front-mounted fastening mechanism configured to be operable with wet hands during donning and removal of the device.

10. The breast support device of claim 1, wherein the support platform is contoured to conform to under-breast anatomy.

11. The breast support device of claim 1, wherein the support platform is made from medical-grade plastic and is configured for medical applications, wherein the medical applications are selected from at least one of a surgical procedure, post-surgical recovery and medical examinations.

12. The breast support device of claim 11, wherein the support platform is made from medical-grade plastic and is configured to provide breast support during a post-surgical recovery shower.

13. A method of providing breast support during showering, the method comprising:

positioning a support platform beneath breasts to provide support without enclosing the breasts, the support platform comprising drainage openings and configured to be secured to a user by a strap system;

distributing breast weight across the support platform; and allowing shower water to flow through the drainage openings while maintaining breast support.

14. The method of claim 13, further comprising providing an adjustment mechanism and adjusting the strap system to accommodate user body size, wherein the adjustable shoulder straps comprise integrated swivel mechanisms positioned along a length of the shoulder straps.

15. The method of claim 13, further comprising providing a front closure mechanism on the support platform and fastening the support platform with the front closure mechanism to secure the device to the user.

16. The method of claim 13, wherein positioning the support platform comprises providing underneath lift without enclosing breasts from front or sides.

17. The method of claim 13, further comprising cleaning the breasts during showering while the support platform provides support from underneath.

18. A breast support device for preventing breast sagging while showering, the device comprising:

a support platform configured to provide underneath support to breasts, the support platform comprising a rigid substrate;

a strap system coupled to the support platform and configured to secure the support platform to a user's body, wherein the support platform further comprises a plurality of drainage openings configured to drain shower water away from the support platform wherein the strap system comprises adjustable shoulder straps, and wherein the adjustable shoulder straps comprise integrated swivel mechanisms positioned along a length of the shoulder straps.

19. The breast support device of claim 18, wherein the swivel mechanism divides the shoulder straps into upper strap portions and lower strap portions, the swivel mechanisms are configured to provide rotational movement of upper strap portions relative to lower strap portions.

* * * * *